United States Patent [19]

Miller

[11] Patent Number: 4,708,516

[45] Date of Patent: Nov. 24, 1987

[54] ASPHALT PAVEMENT

[76] Inventor: E. James Miller, 12771 Eveningside Dr., Santa Ana, Calif. 92705

[21] Appl. No.: 623,559

[22] Filed: Jun. 22, 1984

[51] Int. Cl.[4] ..... E01C 3/00

[52] U.S. Cl. ..... 404/31; 404/27; 404/82

[58] Field of Search ..... 404/17, 27–31, 404/71, 72, 82

[56] References Cited

U.S. PATENT DOCUMENTS

| | | | |
|---|---|---|---|
| 936,493 | 10/1909 | Travilla | 404/82 X |
| 984,801 | 2/1911 | Davis | 404/81 |
| 1,717,769 | 6/1929 | Gordon | 404/31 |
| 1,977,669 | 10/1934 | Dantz | 404/28 |
| 2,078,485 | 4/1937 | Dunham | 404/31 |
| 2,083,900 | 6/1937 | Ebberts et al. | 404/81 X |
| 2,408,251 | 9/1946 | Dantz | 404/28 |
| 2,837,984 | 6/1958 | Klotz | 404/27 X |
| 3,044,373 | 7/1962 | Sommer | 404/82 X |
| 3,091,543 | 5/1963 | Rhodes | 404/31 X |
| 3,910,710 | 10/1975 | Gagle et al. | 404/31 X |
| 4,002,412 | 1/1977 | Bennett et al. | 404/17 |

FOREIGN PATENT DOCUMENTS

| | | | |
|---|---|---|---|
| 69015 | 1/1983 | European Pat. Off. | 404/31 |
| 2289676 | 5/1976 | France | 404/31 |
| 7213263 | 4/1974 | Netherlands | 404/27 |

*Primary Examiner*—James A. Leppink
*Assistant Examiner*—John F. Letchford

[57] ABSTRACT

An asphalt pavement structural section includes a plurality of material layers arranged to act as an integral mechanical beam. The layers are arranged into a preselected sequence from subgrade to an upper surface course with the layer having the greatest tensile strength positioned adjacent the subgrade.

14 Claims, 15 Drawing Figures

FIG. 1
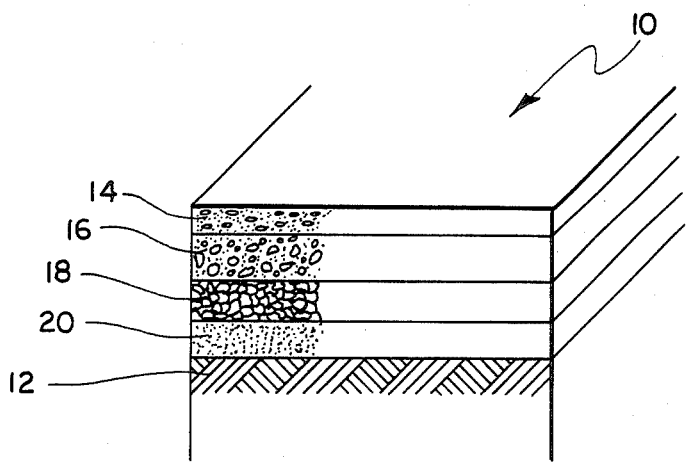
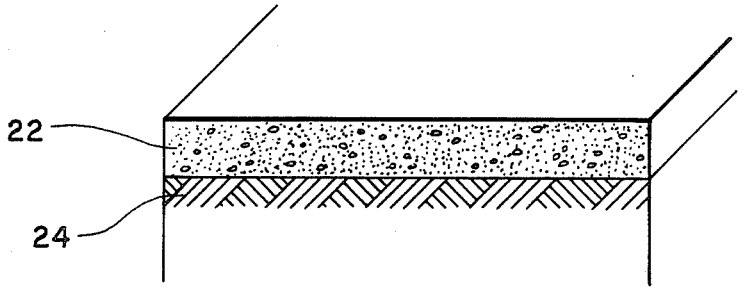
FIG. 2 (PRIOR ART)
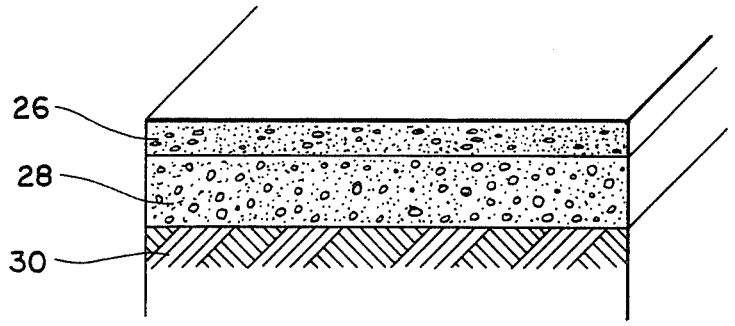
FIG. 3 (PRIOR ART)

FIG. 5A
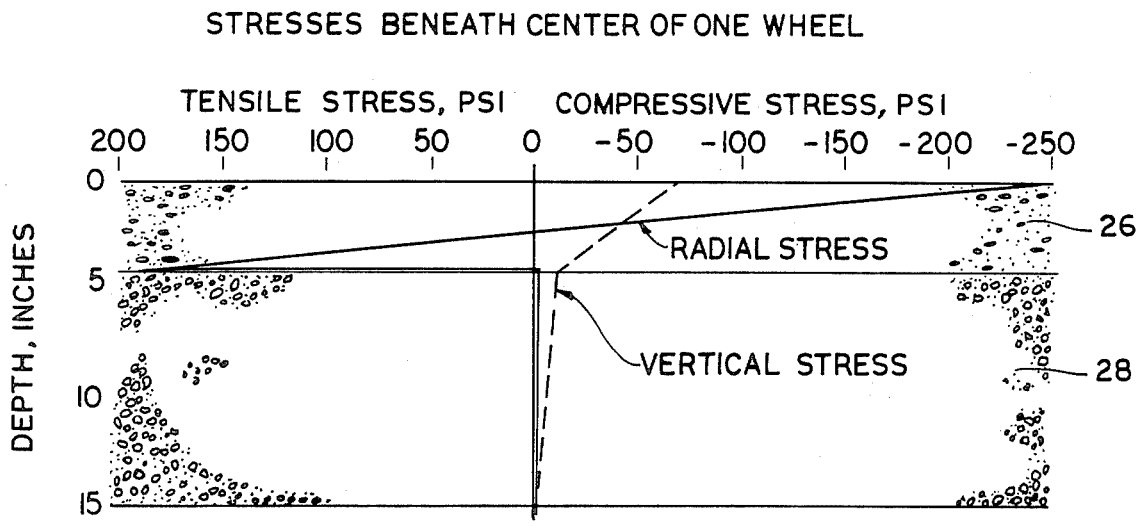
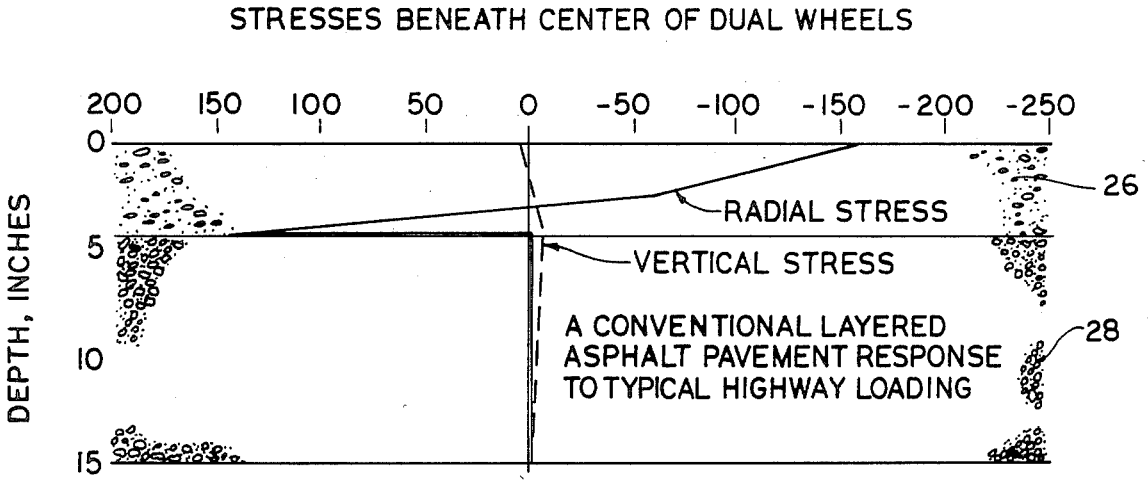
FIG. 5B

FIG. 9
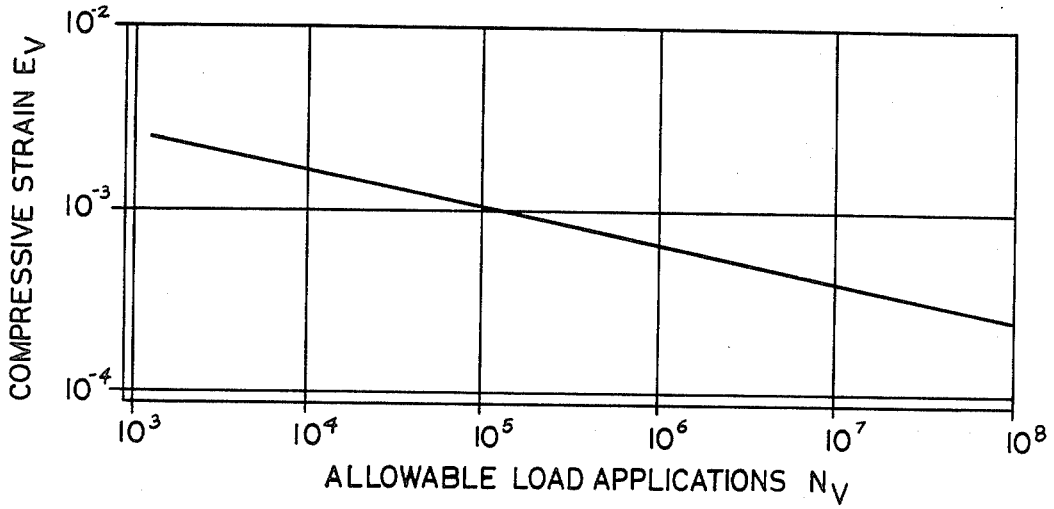
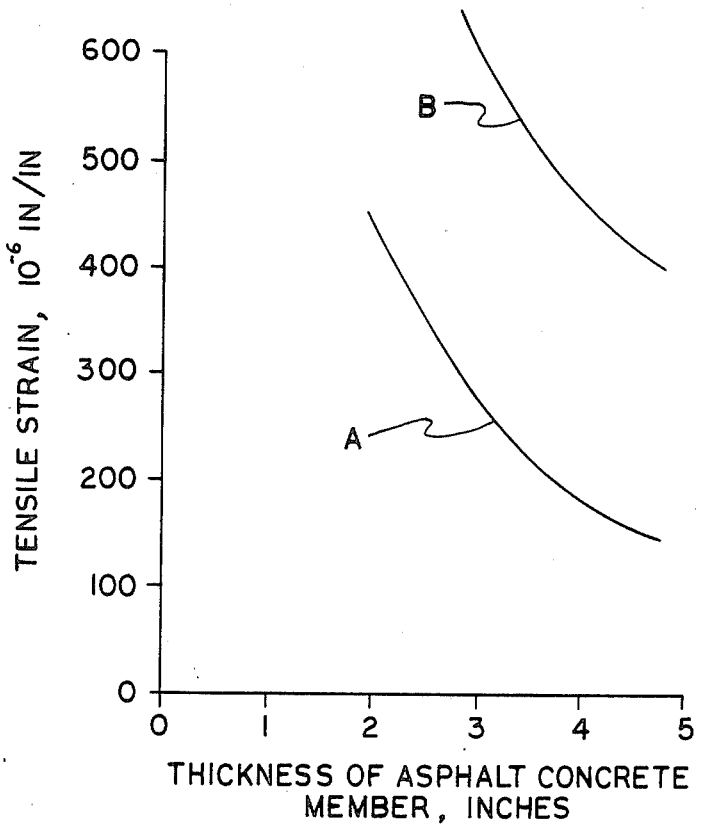
FIG. 11

FIG. 10A
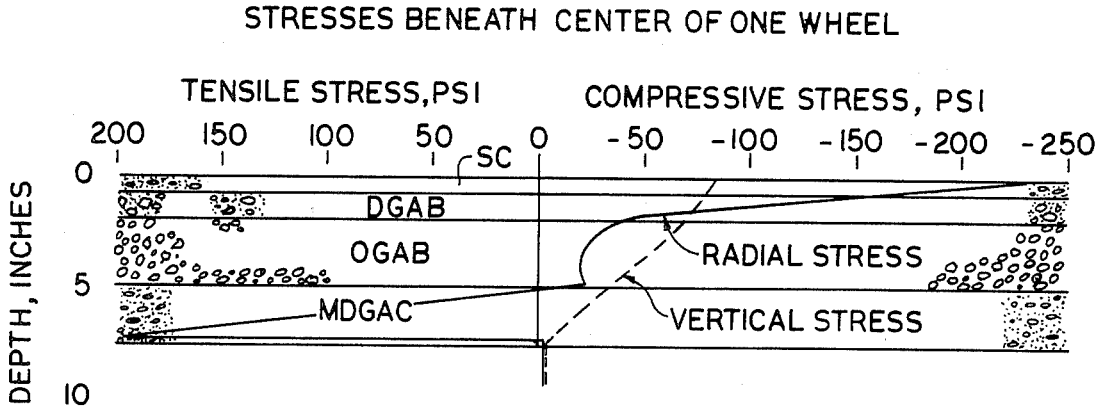
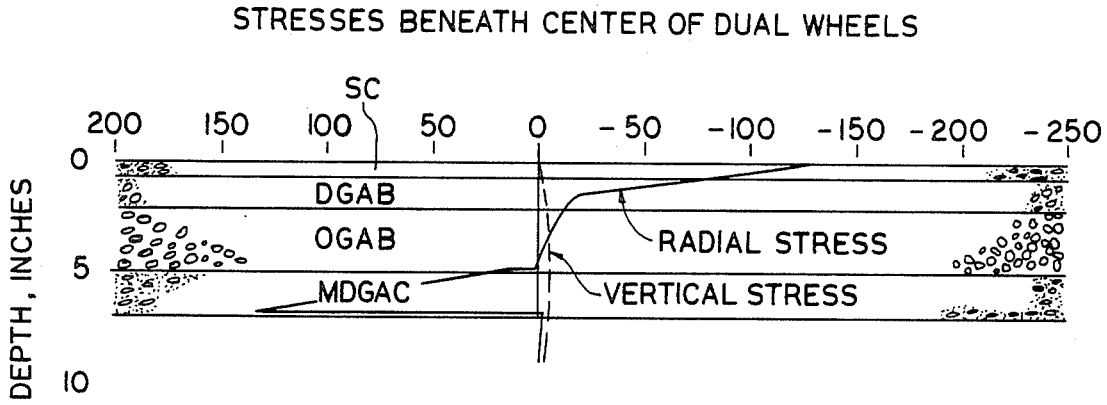
FIG. 10B

ASPHALT PAVEMENT

BACKGROUND

Field of the Invention

The present invention relates to load bearing pavements and their construction. More particularly, this invention pertains to an improved high quality asphalt pavement.

Description of the Prior Art

High quality asphalt pavements find many important uses. They are employed, for example, for highways that carry high volume auto and heavy truck traffic, airport runways and taxiways that service high volume, heavily loaded high density aircraft traffic and in port construction with regard to the transport, storage and transfer of containerized freight.

As used herein, high quality asphalt pavement refers to those pavements that are constructed primarily of high quality construction materials that may generally be obtained only by central plant manufacturing processes and that are placed with specialized construction lay down equipment. This assures that the various pavement materials are properly and uniformly densified, pavement layers are to proper line, grade, and thicknesses and that the upper-most layer provides a smooth riding surface that can safely support high speed vehicle traffic.

Asphalt concrete pavements are classified as flexible pavements as opposed to rigid or Portland cement concrete pavements. The two primary flexible pavement types are layered and full depth asphalt pavement. The full depth asphalt pavement comprises only dense-graded asphalt concrete placed directly on the subgrade. In layered asphalt pavements the highest quality materials are placed in layers nearest the surface. These materials, in the order in which they would probably exist in structural sections, beginning at the subgrade, include soil, pit run gravels, processed gravels, lime and/or cement treated soil and/or gravels, crushed rock and asphalt concrete. Parameters such as the stabilometer value and gravel equivalency factor are numerical measures of quality although in recent years, it has been recognized that asphalt concrete possesses some of the characteristics of a structural slab.

Both empirical and mechanistic methods are presently employed for the design of flexible pavements. Index parameters are often used to describe pavement materials, subgrade characteristics and traffic. Pavement systems generally arranged in accordance with prior art design philosophy and including variations of the above-referenced designs are shown in U.S. Ser. Nos. 936,493 of Travilla, 984,801 of Davis, U.S. Pat. Nos. 2,083,900 of Ebberts, et al., and 3,044,373 of Sommer.

Empirical design methods relate traffic to pavement performance commonly utilizing either a design equation or a series of design charts that relate thickness of the pavement section to projected traffic and strength of the reconstituted subgrade soil. Equivalent material thickness factors are employed to allow substitution of materials of the structural section. The equivalency factors employed vary with the particular design method. However, in general, a 40 to 60 percent reduction in thickness is realized when dense graded asphalt concrete is substituted for aggregate base.

An early empirical design technique is the stabilometer design procedure developed by the State of California and utilized in several of the Western states. A more recently developed empirical method is the AASHO Flexible Pavement Design Method of the American Association of State Highway Officials.

The mechanistic design of pavements is in part founded in fundamental mechanics and based upon well recognized analysis techniques. In mechanistic design the stress and strain fields within the pavement system are identified and the materials of the pavement section characterized. The characterization to be appropriate must reflect the influences of temperature and load rate on asphalt concrete stiffness and fatigue life, stress state on aggregate base and open graded asphalt concrete stiffness, and stress state and moisture content on stiffness and permanent deformation of the subgrade soils.

The identifications of the stress and strain fields are normally accomplished with the aid of elastic layered computer codes that incorporate elastic constants compatible with load rate, temperature, stress state and moisture content. Iterative techniques may be employed to reflect the influence of stress state on elastic constants. Computer analysis of the temperature and moisture fields can aid in the selection of elastic constants that appropriately reflect such environmental factors.

The evaluation of the mechanical design is accomplished by comparisons of the projected strains at critical locations (i.e. depths) of the structural section to predetermined materials failure criteria. While displaying an insight into certain significant mechanical characteristics of commonly employed pavement construction materials and their responses to loading, the prior art has failed to utilize such knowledge to derive optimum systems (i.e. pavement structures) based upon the stress-bearing capacities of conventional materials and thus the powerful mechanistic analytical techniques have not previously produced conceptually new and optimum pavement designs.

SUMMARY OF THE INVENTION

The foregoing and additional shortcomings of the prior art are addressed and overcome by the present invention that provides in a first aspect an asphalt pavement structural section for overlying a subgrade. The structural section includes a plurality of layers of material, such layers being arranged into a preselected sequence extending from the subgrade to an upper surface. The layer having the greatest tensile strength is arranged adjacent the subgrade.

In a further aspect, the invention comprises an improved method for designing an asphalt pavement structural section. This method includes the step of arranging a plurality of layers of material so that only a compressive stress or a tensile stress is borne substantially throughout each of such layers during loading.

The preceding and additional features and advantages of the invention will become further apparent from the detailed description of its presently preferred embodiment that follows. This description is accompanied by a set of drawing figures in which like numerals refer to like features of the invention throughout.

BRIEF DESCRIPTION OF THE DRAWINGS

FIG. 1 is a sectional view of an improved asphalt pavement in accordance with the invention;

FIG. 2 is a sectional view of a full-depth asphalt pavement structural section in accordance with the prior art;

FIG. 3 is a sectional view of a layered pavement structural section in accordance with the prior art;

FIGS. 5(*a*) and 5(*b*) are stress diagrams of the prior art pavement of FIG. 3 under one and two wheel loading respectively;

FIG. 9 is a semi-logarithmic graph illustrating the relationship between vetical strain and the number of load repetitions;

FIGS. 10(*a*) and 10(*b*) are stress diagrams of the pavement of the invention under one and two wheel loading respectively;

FIG. 11 is a graph of tensile strain as a function of the thickness of the asphalt concrete layer of the invention;

DETAILED DESCRIPTION

Figure 4:
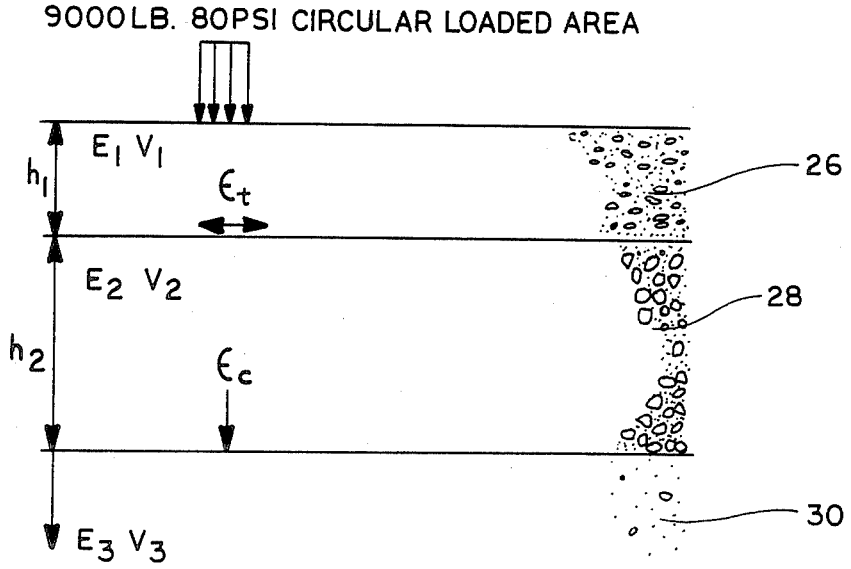
FIG. 4 (PRIOR ART)
FIG. 4 is a structural model of the prior art pavement illustrated in preceding FIG. 3.

Turning now to the drawings, FIG. 1 is a cross sectional view of an improved pavement structural section 10 in accordance with the invention. The structural section includes a preselected arrangement of layers for overlaying a prepared subgrade 12.

The arrangement comprising the invention includes a one-half to two inch thick surface layer 14. The surface layer 14 is supported by dense-graded aggregate material 16 which, in turn, overlies a layer of open-graded aggregate material 18. The open-graded aggregate material 18 is positioned atop a bottom layer 20 comprising modified dense-graded asphalt concrete.

The surface layer 14, which provides a smooth, nonabrading, skid resistant surface, may be dense-graded asphalt concrete, open-graded asphalt concrete or surface treatment. In the event that dense-graded or open-graded asphalt concrete is utilized, the layer 14 will, as a result of lay-down requirements, generally be thicker since a single asphalt surface treatment may produce a layer as thin as ⅜-inch. In the latter case, layer 14 thickness depends on the number of surface treatments and size of rock used in each treatment. A single surface treatment using one-half or three-eighths inch maximum size rock is appropriate for most applications. In the event open-graded asphalt concrete is chosen, it is customarily placed and compacted with the standardized procedures discussed, infra, for manufacture of conventional dense-graded asphalt concrete layers. The dense-graded aggregate material layer 16, as will be shown, is not an essential structural element, but rather serves primarily to form a surface on which the surface layer 14 is more readily constructed. It will be appreciated that the layer 16 has unconfined stability as required to support traffic for construction of the surface layer 14.

The open-graded aggregate material layer 18 is essentially of single size crushed rock having a maximum size between one and two inches, with less than two to three percent passing a 200 sieve. The manufacture of the layer 18, (i.e., spreading and compaction) is essentially the same as for dense-graded aggregate material, described infra, with the majority of compaction accomplished by means of rollers operating on the overlying dense-graded aggregate material layer 16.

The modified dense-graded asphalt concrete layer 20 is constructed essentially as a conventional dense-graded asphalt concrete layer. The modified layer differs, however, in that the optimum mix design may utilize a more viscous/paving grade asphalt cement and at greater bitumen content (about 0.5 to 1.5 percent greater bitumen content than in prior art dense-graded asphalt concrete; the exact amount will vary in accordance with standard engineering practice taking into account gradation of rocks, etc.) than in standardized dense-graded asphalt concrete. In addition, the layer 20 may be placed at a higher compacted density that, in conjunction with the higher percentage of asphalt cement, provides greater stiffness, fatigue life and substantially lower hydraulic conductivity.

FIGS. 2 and 3 are cross sectional views of conventional asphalt concrete pavements in accordance with the prior art. In FIG. 2 there is disclosed a conventional full-depth asphalt concrete pavement comprising a unitary slab or layer 22 of dense-graded asphalt that overlies a subgrade 24. The prior art pavement of FIG. 3 includes a multi-layered construction section comprising a surface layer 26 of dense-graded asphalt concrete that overlies a layer 28 of dense-graded aggregate base 30. The layered construction section overlies a subgrade 30.

A discussion of the characteristics and essential properties of the materials utilized by the present invention and conventional pavements follows. As mentioned, construction materials include dense and open-graded asphalt concrete and dense and open-graded aggregate base.

PAVEMENT SYSTEM

Materials Composition

Asphalt concrete essentially comprises a mix of well (dense) graded or poorly (open) graded aggregate and a paving grade asphalt cement (bitumen) at elevated temperature. In certain instances, the open-graded asphalt concrete, may be manufactured with emulsion bitumen—normally a cold mix process—but often at partially elevated temperatures, i.e., above ambient but lower than normally required where liquid asphalt cements are used. Open-graded asphalt concrete is relatively new with less than 20 years of service. In the last 10 years open-graded asphalt concrete has become accepted as a high quality pavement material utilized primarily as a surface course as a result of its characteristic high skid resistance. Unlike open-graded asphalt concrete, dense-graded asphalt concrete must be manufactured with a paving grade asphalt cement to assure a degree of control of density and air void content that cannot be achieved by means of cold mix processes (e.g. emulsions or liquid asphalts) that incur a post-construction loss of fluid. The character of the asphalt concrete is effected by the bitumen content. Bitumen content serves to control the air voids in dense-graded asphalt concretes. Values between 4 and 6 percent are generally sought; however, actual values generally range between 5 and 10 percent. Typical specifications for paving grade asphalt are listed below:

Paving Asphalt

General. Paving asphalt shall be a stream refined asphalt produced from crude asphaltic petroleum or a mixture of refined liquid asphalt and refined soil asphalt. It shall be homogeneous and free from water and residues from distillation of coal, coal tar, or paraffin oil.

Testing Requirement. Asphalts shall be specified by viscosity grade and shall conform to the requirements of the following table:

| Specification Designation | ASTM Test No. | Viscosity Grade AR 1000 | AR 2000 | AR 4000 | AR 8000 | AR 16000 |
|---|---|---|---|---|---|---|
| TESTS ON RESIDUE FROM RTFO PROCEDURE Test Method No. Calif 346E* | | | | | | |
| Absolute viscosity at 140° F. poise | D 2171 | 750–1250 | 1500–2500 | 3000–5000 | 6000–10000 | 12000–20000 |
| Kinematic viscosity (minimum) at 275° F. centistokes | D 2170 | 140 | 200 | 275 | 400 | 550 |
| Penetration (mm) (minimum) at 77° F. 5 sec. at 100 gm. | D 5 | 65 | 40 | 25 | 20 | 20 |
| Percent of original penetration at 77° F. (minimum) | D 5 | — | 40 | 45 | 50 | 52 |
| Ductility at 77° F. cm. min. | D 113 | 100** | 100** | 75 | 75 | 75 |
| TESTS ON ORIGINAL ASPHALT | | | | | | |
| Flash Point Cleveland Open Cup °F. (minimum) | D 92 | 400 | 425 | 440 | 450 | 460 |
| Solubility in trichloroethylene, % (minimum) | D 2042 | 99 | 99 | 99 | 99 | 99 |

*TFO may be used but RTFO shall be the reference method.
**If the ductility at 77° F. is less than 100 cm., the material will be acceptable if its ductility at 60° F. (16° C.) is more than 100 cm.
(This Table and all others herein taken from "Standard Specifications for Public Works Construction" by the Joint Cooperative Committee of the Southern California Chapter of the American Public Works Association and the Southern California District of Associated General Contractors of California (1982 Edition).

The gravel fraction of the aggregate for both open and dense-graded asphalt concrete is composed of angular as opposed to rounded, particles. Generally, a minimum number of fractured faces per unit is specified. In the case of dense-graded asphalt concrete, a mineral filler may be included. Such filler, typically finer than a number 200 sieve, generally constitutes a maximum of 3 to 5 percent of total volume. The aggregate for asphalt concrete may also be subject to specifications on durability and, to a lesser extent, hardness and mineralogy of the particles. These characteristics may be judged from mechanical and chemical tests designed to break down the aggregate or cause disruption to cemented brickettes. Typical specifications for the aggregate are as follows:

Materials

Asphalt. The asphalt to be mixed with the aggregate shall be paving asphalt.

Aggregate. Crushed aggregate shall be crushed rock and shall meet the following requirements:

| Test | Test Method No. | Requirements |
|---|---|---|
| Percentage Wear | ASTM C 131 | |
| 100 revolutions | | 15 Max. |
| 500 revolutions | | 52 Max. |

Fine aggregate for asphalt concrete shall be sand, rock dust, crushed slag, mineral filler, or a blend of these materials.

If the fine aggregate for asphalt concrete is deficient in material passing the No. 200 sieve, mineral filler shall be added to meet the combined grading.

Mineral Filler. Mineral filler shall consist of Portland cement or finely powdered material mechanically produced by the crushing of rock. The mechanically reduced rock shall conform to the following grading when tested in accordance with ASTM D 422:

| Particle Size | Percentage |
|---|---|
| Passing No. 200 Sieve | 75–100 |
| Finer than .05 mm | 65–100 |
| Finer than .02 mm | 35–65 |
| Finer than .01 mm | 26–35 |
| Finer than .005 mm | 10–22 |

Combined Aggregates

General. The samples of combined aggregates, after all processing except the adding of asphalt and mineral filler, shall have a 50 minimum sand equivalent when tested by Test Method No. California 217.

Composition and Grading. The grading of the combined aggregates and the percentage of asphalt shall be such as to conform to the requirements indicated in the following tabulations in which the percentages shown are based on the weight of dry aggregate only:

| Sieve Size (mm) | Percentage Passing Sieve |
|---|---|
| 1½" (38.1) | 100 |
| ¾" (19.0) | 90–100 |
| ⅜" (9.5) | 50–80 |
| No. 4 | 35–55 |
| No. 30 | 10–30 |
| No. 200 | 2–9 |
| ASTM C 131 Test Grading | |

Quality Requirements. The material shall conform to the following:

| Tests | Test Method No. | Requirements |
|---|---|---|
| R-Value[1] | Calif. 301 | 80 Min. |
| Sand Equivalent | Calif. 217 | 50 Min. |
| Percentage Wear | ASTM C 131 | |
| 100 revolutions | | 15 Max. |
| 500 revolutions | | 52 Max. |
| Specific Gravity (Bulk saturated surface dry) | ASTM C 127 | 2.58 Min.[2] |

[1]The R-Value requirement will be waived, provided the material has an SE of 55 or more.

[2]Not more than 15 percent by weight shall be particles with a bulk specific gravity below 2.50.

| Sieve Size (mm) | Percentage Passing Class A Coarse Min. | A Coarse Max. | B Medium-Coarse Min. | B Medium-Coarse Max. | C Medium Min. | C Medium Max. | D Fine Min. | D Fine Max. | E Extra Fine & Curb Min. | E Extra Fine & Curb Max. |
|---|---|---|---|---|---|---|---|---|---|---|
| 1½ (38.1) | 100 | | | | | | | | | |
| 1 (25.4) | 90 | 100 | 100 | | | | | | | |
| ¾ (19.0) | 78 | 90 | 95 | 100 | | | | | | |
| ½ (12.7) | 64 | 78 | 74 | 88 | 95 | 100 | 100 | | | |
| ⅜ (9.5) | 54 | 68 | 62 | 76 | 72 | 88 | 95 | 100 | 100 | 100 |
| No. 4 | 34 | 48 | 38 | 62 | 46 | 60 | 58 | 72 | 65 | 85 |
| No. 8 | 25 | 35 | 28 | 40 | 28 | 42 | 34 | 48 | 45 | 65 |
| No. 30 | 12 | 22 | 14 | 24 | 15 | 27 | 18 | 32 | 22 | 38 |
| No. 50 | 8 | 16 | 10 | 18 | 10 | 20 | 13 | 23 | 16 | 28 |
| No. 200 | 3 | 6 | 3 | 7 | 4 | 7 | 5 | 9 | 6 | 12 |
| Asphalt Binder % | 4.5 | 5.5 | 4.6 | 5.8 | 4.8 | 6.0 | 4.8 | 6.5 | 6.0 | 8.0 |

Note:
When slag aggregate is used, the maximum percentage for asphalt binder may be increased 2.0 over the values shown above.

The exact proportions of aggregate and the amount of asphalt binder for each type of mixture shall be regulated as directed by the Engineer.

Particle specifications, such as percentage wear and hardness, are similar for both dense-graded and open-graded asphalt concrete design. A typical gradation specification for the open-graded asphalt concrete mix including 3 percent AR4000 paving grade asphalt is listed below:

| Sieve Size | Percent Passing (Sieve) |
|---|---|
| 1.0 inch | 100 |
| #10 | 0–12 |
| #200 | 0–2 |

The aggregate material may also be dense or open-graded. The gravel fraction of a high quality material is characterized by angular particles specified as to fractured faces and durability in a manner similar to the specification of the aggregate used in asphalt concrete. Typical, although not exclusive, specifications for aggregate for use in dense-graded aggregate material and open-graded aggregate material are listed below:

General. Crushed aggregate shall consist entirely of crushed rock and rock dust.

Grading. The aggregate shall be uniformly graded and shall conform to the following gradation:

The Engineer may waive percentage wear and specific gravity requirements, provided that the material has a minimum durability of 40 in accordance with Test Method No. Calif. 229.

Rock Products

General. The following specifications set forth the requirements for crushed rock and gravel.

All rock products shall be clean, hard, sound, durable, uniform in quality, and free of any detrimental quantity of soft, friable, thin, elongated or laminated pieces, disintegrated material, organic matter, oil, alkali, or other deleterious substance. Unless otherwise specified, all percentages shall be determined by weight.

Crushed Rock and Rock Dust. Crushed rock shall be the product of crushing rock or gravel. The portion of the material that is larger than will pass a ⅜-inch (9.5 mm) sieve, shall contain at least 50 percent of particles having three or more fractured faces. Not over 5 percent shall be pieces that show no such faces resulting from crushing. Of that portion which passes the ⅜-inch (9.5 mm) sieve but is retained on the No. 4 sieve, not more than 10 percent shall be gravel particles. Crushed rock will be designated by nominal size and shall conform to the following gradations:

| Sieve Size | Percentage Passing Sieves 1" | ¾" | ½" |
|---|---|---|---|
| 1½" | 100 | — | — |
| 1" | 90-100 | 100 | — |
| ¾" | 30-60 | 90-100 | 100 |
| ½" | 0-20 | 30-60 | 90-100 |
| ⅜" | — | 0-20 | 20-60 |
| No. 4 | 0-5 | 0-5 | 0-15 |
| No. 8 | — | — | 0-5 |
| Test Grading | A | B | B |

Gravel shall be composed entirely of particles that have no more than one fractured face.

Construction Process

Standard practices, often defined in appropriate public agency codes, exist with regard to the placement of a structural section. Conventionally, the subgrade is prepared to required alignment (horizontal and vertical) and depth, then compacted to a minimum density prior to construction. Compaction specifications for municipalities (listed in "Specification for Public Works Construction") specify that the upper six inches of the subgrade supporting base or subbase and the asphalt concrete be compacted to ninety and ninety-five percent of the maximum density respectively as determined in accordance with ASTM Test Designation D 1557-70.

Construction of prior art structural sections has included the placement of aggregate base or asphalt concrete directly on prepared subgrade. Often a naturally occurring material of higher quality than the subgrade soil, known as subbase, is placed upon the subgrade prior to placing base or asphalt concrete. In such cases, the specifications for compaction of such a layer are identical to those for the subgrade.

Dense-graded aggregate materials are generally compacted to ninety-five percent of maximum laboratory density. Compaction specifications for open-graded aggregate materials, however, are generally not specified, as such bases are rarely employed as structural elements but rather serve primarily as drainage layers. When used, special care is be taken to assure physical separation from adjacent unbound materials. Fabric separators are occasionally employed in the event that contact exists with native soils rather than well-graded gravels.

The compaction of dense-graded asphalt concrete is specified in terms of either laboratory or theoretical maximum densities. When the former is specified, the required compaction is, as stated above, generally ninety-five percent. When the latter is employed, the typical compaction criterion is ninety-two percent.

Laydown temperature and the type and number of compactors for the asphalt concrete layer are also standardized in current procedures. The specifications for open-graded asphalt concrete are generally similar to those for dense-graded asphalt concrete. However, minimum compaction density is not normally specified for open-graded asphalt concrete. Rather, upon compaction and, while still hot, an uppermost layer of asphalt concrete may be choked, (i.e., covered with between 5 and 10 pounds per square yard of sand) and shot with either emulsion or hot paving grade asphalt to a typical content of between 0.15 to 0.25 gallons per square yard to provide a dense appearing surface. The latter process is generally omitted when the primary function of the open-graded asphalt concrete surface is to provide a friction or skid resistant course.

Mechanical Properties

FIG. 4 is a structural model for a conventional layered pavement as shown in FIG. 3. The parameters indicated on FIG. 4 are defined below:

$e_1$ = Critical tensile strain in dense-graded asphalt concrete $e_0$ = Critical compressive strain in subgrade $h_1$ = Thickness of Layer 1

$E_1$ = Youngs Modulus of Layer 1

$v_1$ = Poissons Ratio of Layer 1

Measurements of inservice pavements have demonstrated the validity of computer stress analyses of the structural model of FIG. 4, providing material characterizing parameters appropriately reflect load, dwell time and environmental conditions. The stress distributions in such systems are typically as depicted on FIGS. 5(*a*) and 5(*b*), computer generated stress diagrams of the response of a prior art layered construction section (shown in FIG. 3) to typical highway loading. As shown, the vertical stress under both one wheel (FIG. 5(*a*)) and two wheel (FIG. 5(*b*)) loading typically decays rapidly (with increasing depth) within the dense-graded asphalt concrete layer 26 but at a substantially reduced rate within the dense-graded aggregate base layer 28 lying therunder. In addition, a high radial stress level exists at the upper surface of the layer 26, reversing near the neutral axis to become a high tensile stress level at the bottom of the asphalt concrete layer 26. Beneath the layer 26, only a low compressive stress is borne by the aggregate base 28, such stress decaying with depth.

Pavement failure occurs when the surface layer 26 becomes cracked and distorted. Cracking occurs when sufficient load repetitions cause the dense-graded asphalt concrete to fail in fatigue with the cracks initiating at the bottom of the pavement and propagating upward through the layer. Rutting distress occurs when sufficient load repetitions cause accumulative plastic deformation of the subgrade soil.

Figure 6:
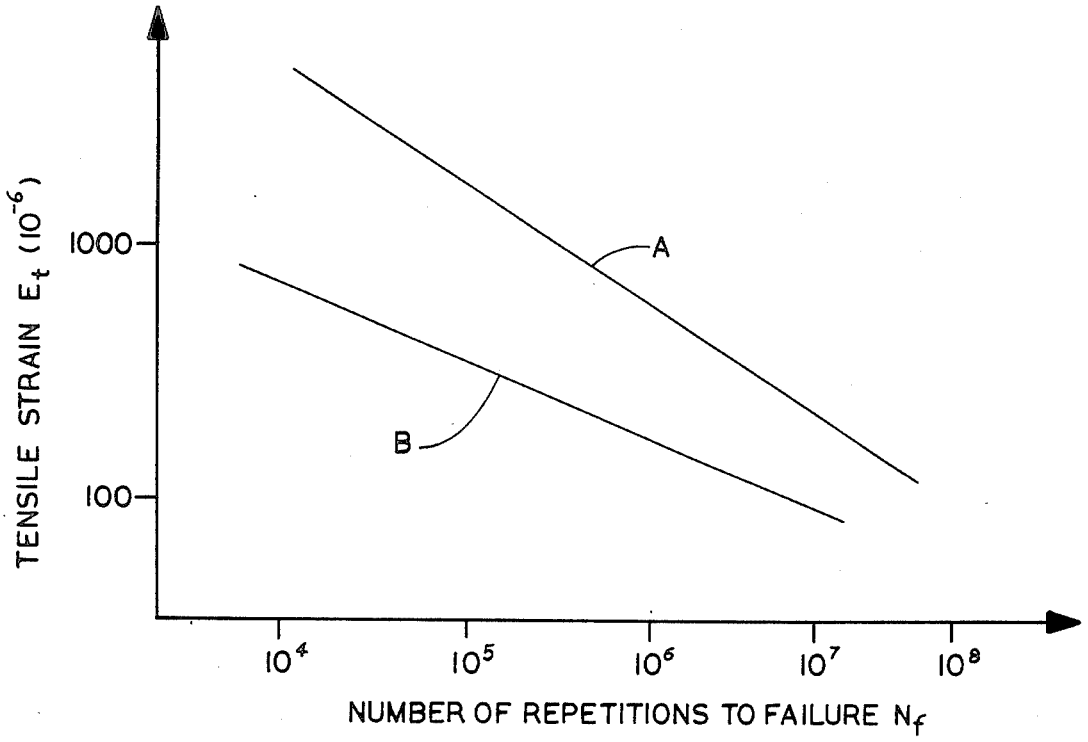
FIG. 6 is a graph which illustrates a typical fatigue rupture relationship for dense graded asphalt concrete.

It has been demonstrated, in laboratory and field studies, that dense-graded asphalt concrete develops a fatigue failure under repeated short duration tensile loading. The general relationship between number of loading repetitions and tensile strain within a dense-graded asphalt concrete layer is shown in FIG. 6. Failure is typically expressed as a logarithmic relationship between the repeated maximum strain level and the number of repetitions at which the material fractures.

Under long duration temperature induced deformation, the viscosity of the bitumen allows the asphalt concrete to relax under load to prevent temperature induced cracking at moderate temperatures and/or rates of temperature change. Mixture variables such as character and amount of filler, type and amount of bitumen, placement density and in service air void content influence fatigue strength and stiffness. In FIG. 6, the responses depicted on Curve "A" differ from those of curve "B" in terms of temperature (greater) loading rate (slower), asphalt viscosity (less), gradation (open), air void content (increased) and asphalt content (decreased). Certain variables such as temperature and load dwell time can have an apparent inverse effect on fatigue strength when failure is expressed in terms of the fatigue stress as opposed to the fatigue strain. For example, increased temperature or reduced load dwell time can cause the material to resist greater stress levels prior to fracture but increase brittleness, producing a lower failure strain level. The influences of other variables are less clear. For example, increased bitumen content generally increases fatigue life while causing the material to behave "softer". On the other hand, increased bitumen content generally increases the compacted density and produces a stiffer mixture, a lower air void content and consequent greater fatigue life.

Figure 7:
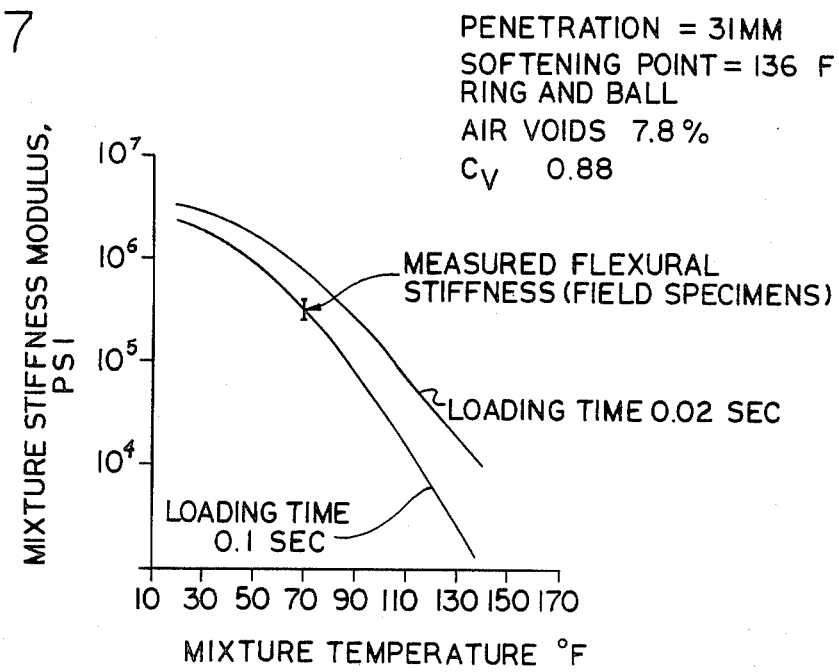
FIG. 7 is a graphical representation of the Young's Modulus behavior of dense-graded asphalt as a function of loading time and mixing temperature.

The Young's Modulus for dense-graded asphalt concrete is an increasing function of loading time and a decreasing function of temperature as shown in the graph of FIG. 7. Typically, the Poisson's Ratio for dense-graded asphalt concrete lies in the range of 0.4 to 0.5.

Hydraulic conductivity of dense-graded asphalt concrete is extremely sensitive to bitumen content. Typical values range between 0.1 and 1.0 feet per day for conventional mixes that generally have air void contents greater than five or six percent. Values as low as 0.0001 feet per day may be realized when air void content is less than two to three percent. Thermal properties of dense-graded asphalt concrete include a conductivity of approximately 0.8 BTU's per degree Fahrenheit per hour per foot of depth and specific heat of approximately 0.15 BTU's per pound per degree Fahrenheit.

Open-graded asphalt concrete is normally not characterized by a tensile fatigue failure criterion as it possesses relatively little tensile strength. Typical failure stress levels for open-graded asphalt concrete are orders of magnitude less than dense-graded asphalt concrete at the same temperature and loading conditions.

Applicant has found that open-graded asphalt concrete possesses little stiffness under tension and will separate under low magnitude load applications (less than 10 pounds per square inch stress). However, in compression, its Young's Modulus is equal to and may even exceed that of dense-graded asphalt concrete, making it an ideal surface course. Further, the stiffness of the open-graded asphalt concrete increases significantly with confinement, observing the following type of relationship:

$$E = K\theta^n$$

where E is Young's Modulus, $\theta$ is the first stress invariant and K and n are coefficients influenced by load duration and temperature. Values for K and n for typical traffic loading and temperature conditions are of the order of 100,000 and 0.3 to 0.5 when the Young's Modulus and first stress invariant are in units of pounds per square inch. The high void content, generally in excess of twenty percent, allows water to flow freely through the open-graded asphalt concrete. Hydraulic conductivity is typically in excess of 1000 feet per day. Thermal properties are similar to that of dense-graded asphalt concrete.

Stiffness of aggregate material is also sensitive to its stress environment. Typically aggregate material stiffness observes the exponential function that describes open-graded asphalt concrete. Values of K and n for aggregate base generally range between 2,000 and 5,000 and between 0.4 and 0.70 for dense-graded aggregate material when the Young's Modulus and first stress invariant are expressed in units of pounds per square inch. Open-graded aggregate material has a somewhat higher modulus value than dense-graded aggregate material in a similar stress environment.

Figure 8:
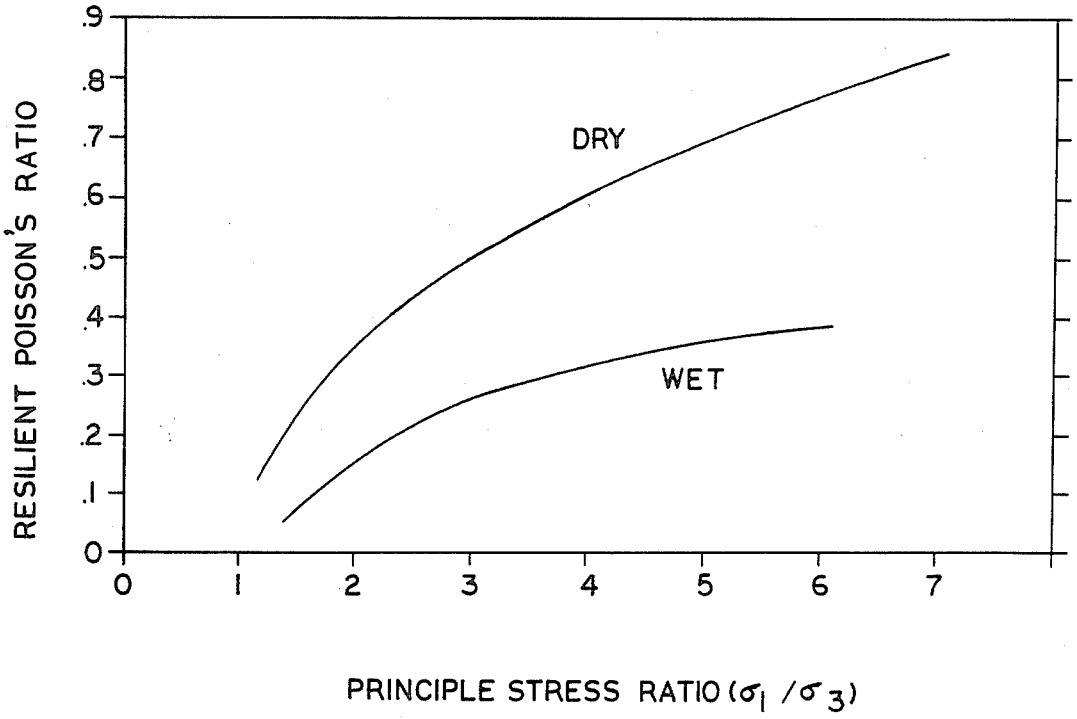
FIG. 8 is a graph illustrating the Poisson's Ratio of dense-graded aggregated material as a function of stress.

The Poisson's Ratio of dense-graded aggregate material is also a function of stress as shown in the graph of FIG. 8. The dependency of the Poisson's Ratio on stress is similar for open-graded aggregate material but is probably not sensitive to moisture conditions. Hydraulic conductivity of dense-graded aggregate material is typically between 0.1 and 10 feet per day. Hydraulic conductivity of open-graded aggregate material is typically in excess of 1000 feet per day. Thermal conductivities of aggregate materials are quite variable, reflecting variations in water content and unit weight. For saturated dense-graded aggregate material, a value in excess of 25 BTU's per degree Fahrenheit per hour per foot of depth is reasonable. The respective approximate thermal conductivities for glass and water and 0.5 and 300 BTU's per degree Fahrenheit per hour per foot of depth. In open-graded aggregate material the thermal conductivity approaches that of asphalt concrete, less than 1.0 BTU per degree Fahrenheit per hour per foot of depth. Specific heats of aggregate material also reflect moisture content as the respective unit values for water and mineral are 1.0 and 0.17 BTU's per degree Fahrenheit per hour per foot of depth.

Stiffness sensitivity of natural soils to moisture content and stress state depends on the character of the subgrade soil. Generally, Young's Modulus decreases as an inverse function of the stress deviation.

The more plastic clay soils are most sensitive to moisture content. Generally Young's Modulus will range between 2,000 and 10,000 pounds per square inch. Plastic clays having high moisture content lie at the lower end of the range while sands lie at the upper end. Subgrade failure is generally expressed by a semi-logarithmic relation between vertical strain and number of repetitions as shown in the graph of FIG. 9. Failure criteria have been developed from rut depth and traffic load measurements on inservice pavements, generally classifying pavement failure at rut depths of 0.5 inches or greater.

Pavement Characteristics

Applicant has applied the foregoing mechanical characteristics and others in deriving the improved layered asphalt pavement illustrate in FIG. 1. In designing the pavement of the invention, Applicant has sought to attain an arrangement of structural material that, in combination: maximizes pavement strength and fatigue failure resistance at minimum cost; minimizes water conductivity into the underlying subgrade while providing efficient lateral transport of infiltrated surface waters out of the pavement; provides for thermal insulation of the tensile resistant member heretofore not available in prior art pavements; improves thermal insulation of the subgrade thus reducing the potential for detrimental thermal cracking of the tensile resistant member and frost heave of the subgrade; and provides a smoother and abrasion-resistant course and provides other advantageous benefits.

In summary, Applicant has found that a layered pavement in accordance with the invention is characterized by the following mechanisms: fatigue rupture strain (or stress) and Young's Modulus (a measure of stiffness) of the dense-graded asphalt concrete level 20 are functions of asphalt mixture, temperature during loading and load duration; the Young's Modulus of an open-graded asphalt concrete layer 14 is dependent upon the stress and temperature environment during loading and load duration; the Young's Modulus and Poisson's Ratio of the aggregate layers 16 and 18 are functions of stress; and the Young's Modulus of the subgrade soil 12 is a function of stress state and moisture content. The Young's Modulus of the dense-graded aggregate base layer 16 is additionally a function of moisture content, such, that the Modulus may be affected significantly when saturated if not allowed to drain during loading. Additionally, the temperature, moisture conductivity and diffusion characteristics of the layers comprising the section 10 affect the response of the pavement to the natural environment. These characteristics of the pavement of the invention reflect a heretofore unrealized combination of the mechanical characteristics of the component layers of the structural section and subgrade.

In contrast to prior art pavements, the economy of the present invention is evident. The relative costs of a layer of dense-graded asphalt concrete, open-graded asphalt concrete, dense-graded aggregate base and open-graded aggregate base exist in an approximate ratio of 20:15:5:4. Thus ample use of the lower cost materials can provide a significant advantage over, for example, the prior art full depth pavement that employs the highest cost material exclusively. As will be seen below, by arranging the layers in accordance with the invention, the beam action that causes compressive stress in the upper portion of the pavement section and tensile stress in its lower portion causes the dense-graded asphalt concrete layer to experience primarily tensile stress. Overlying layers will be seen to isolate the asphalt concrete layer from compression. Such isolation allows a thinner layer of this relatively costly material to be employed than in either of the prior art full depth or layered pavement which impose higher crack-propagating flexure on the asphalt concrete layer. Further, the overlying layers develop sufficient stiffness in compression to allow the combination of layers to act as a single integral beam structure.

The following set of drawing figures provides a graphic contrast of the mechanics of the pavement of the invention with the prior art layered asphalt pavement. FIGS. 10(*a*) and 10(*b*) are computer generated stress diagrams of a pavement according to the invention (i.e. as shown in FIG. 1) under one and two wheel loading. These diagrams reflect loading identical to that of FIGS. 5(*a*) and 5(*b*) for prior art layered pavement. As opposed to the prior art layered pavement, the entire structural section of the invention acts as a unitary structural beam. This is seen in both FIGS. 10(*a*) and 10(*b*) by the gradual reversal of the radial stress component from compressive to tensile throughout the section's plurality of layers. In the prior art pavements, both full depth and layered versions, the sole tensile stress-bearing layer is located at the top of the section. As a result, this layer alone exhibits beam action (i.e. its upper portion is in compression and its lower portion is in tension). The remaining layers, which are of lower quality, cohesion and negligible tensile strength, do not participate in the mechanical beam-like response. Rather, the underlying layers and/or subgrade only bear compressive forces, both vertically and radially.

In the invention, as seen in FIGS. 10(*a*) and 10(*b*), the combination of beam action and compression-bearing overlying layers 14, 16 and 18 results in substantially pure tension throughout the high quality dense-graded asphalt concrete layer 20. The layers 14, 16 and 18 thus act mechanically to isolate the layer 20 from compression stress.

By maintaining the tensile stress bearing layer 20 in pure tension, the flexure that takes place within the tensile strength bearing layers of the prior art under repetitive loading is nearly avoided. Reduction of such flexure is an important attribute of the present design. Fractures in pavements result from tensile stress. Propagation of fractures or cracks and consequent failure of the entire pavement are facilitated significantly by such flexure. Although a crack may occur in the bottom surface of the layer 20, its subsequent propagation upward through the entire structural section is prevented with consequent destruction of the pavement occurring at a far slower rate than in prior art pavements.

Further, the fracture process is itself retarded by the enhanced bitumen content and, in part, by the associated increased density of the asphalt concrete mixture of the layer 20 that, as mentioned, substantially improves fatigue resistance of the asphalt concrete. The combination of enhanced bitumen content and a structural design that reduces flexture of the tensile stress bearing layer allows a pavement construction having a thinner asphalt concrete layer and hence lower overall pavement cost. Finally, by placing the dense-graded asphalt concrete layer 20 having enhanced bitumen content at the bottom of the structural section, a membrane-like barrier to water conductivity is created to limit harmful seepage into the subgrade. The less dense layers atop the asphalt concrete, on the other hand, permit advantageous drainage laterally from the structural section to maintain the stiffness and compressive stress bearing capability of the overall design. The drained aggregate materials provide for substantially improved thermal resistance.

Figure 12:
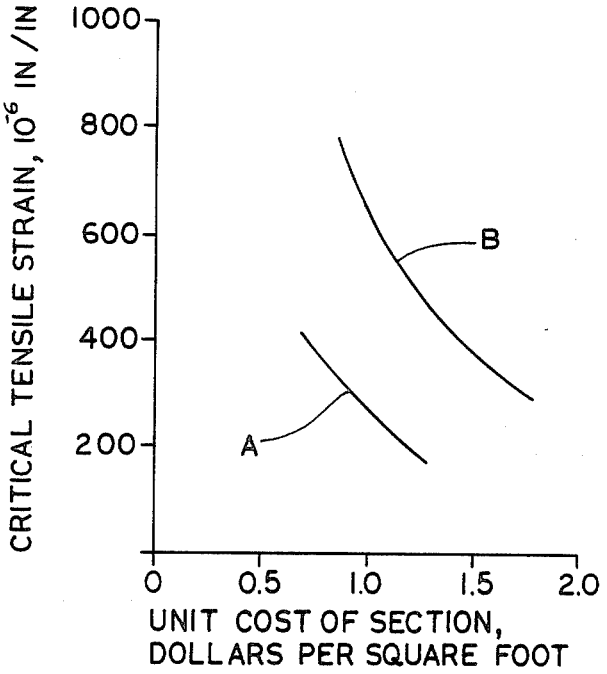
FIG. 12 is a graph of critical tensile strain as a function of unit cost.
Figure 13:
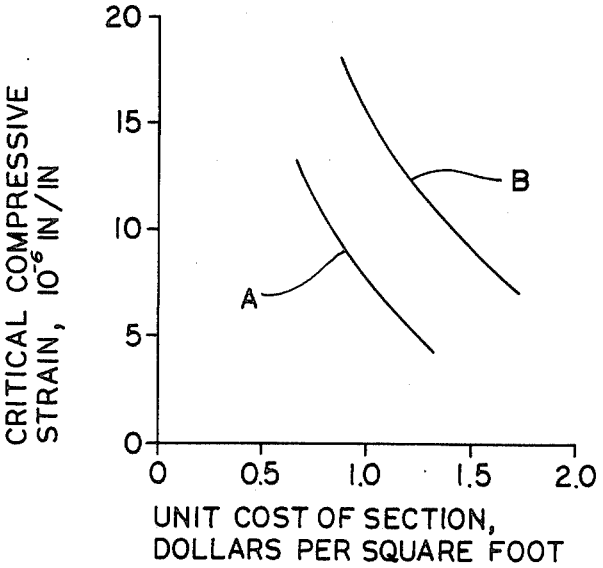
FIG. 13 is a graph of critical compressive strain as a function of unit cost.

FIGS. 11, 12 and 13 are a set of computer-generated graphs comparing certain essential mechanics and costs of a pavement in accordance with the present and a conventional layered prior art pavement as shown in FIG. 3. Pavements were analyzed on the assumption that the moduli of the dense-graded and modified dense-graded asphalt concrete was 300,000 p.s.i. and that of the subgrade was 5,000 p.s.i.

The graphs of FIG. 11 present the maximum or controlling tensile strain at the bottom of the asphalt concrete layer under representative highway loading and environmental conditions as a function of the thickness of the layer. Curve A represents the relationship for the modified dense-graded asphalt concrete layer 20 of the invention while Curve B represents the relationship for the dense-graded asphalt concrete layer 26 of FIG. 3. As is clearly shown, considerably less tensile strain is found in the asphalt concrete layer of the invention than in that of the prior art for a given layer thickness. Conversely, a thinner asphalt concrete layer corresponds to a given level of tensile strain in pavement of the invention than in the prior art layered pavement, it being noted that strain is a decreasing function of layer thickness.

The obvious cost advantage inherent in a pavement design that includes a thinner asphalt concrete layer is evident from FIGS. 12 and 13, graphical representations of the relationship between the critical tensile and compressive strains within the asphalt concrete layer of the pavement and the unit cost of the entire pavement in dollars per square foot.

Once again Curve A refers to the pavement of the invention and Curve B refers to the prior art layered pavement. As is evident, the thinner asphalt concrete layer of the pavement of the invention results in substantial economies vis a vis the prior art.

Thus it is seen that there has been brought to the structural arts an improved pavement comprising a novel layered structural section. By utilizing the teachings herein, one may achieve a pavement that is substantially superior to prior art high quality asphalt pavements in terms of maintenance, durability, sustained ride quality, salvage value and cost of construction.

While the invention has been disclosed in its presently preferred embodiment, it is by no means intended to be so limited. Rather, its scope is only delimited as defined in the set of claims that follows:

What is claimed is:

1. A beam-like asphalt pavement structural section for overlying a subgrade comprising, in combination:

a. at least three layers of material, said layer being arranged in a preselected sequence from said subgrade to an upper surface;

b. said layers including a bottom layer adjacent said subgrade, a top layer of bounded material defining said upper surface, and an intermediate layer therebetween;

c. the material of said bottom layer comprised of a dense graded asphalt concrete having a greater tensile strength than the other layers; and d. said intermediate layer comprising unbound aggregate filler material of predetermined thickness as to enhance the beam-like action.

2. A beam-like pavement structural section as defined in claim 1 wherein said intermediate layer comprises open graded aggregate filler material of preselected thickness so as to provide an avenue of free movement of water out of the pavement section.

3. A beam-like pavement structural section as defined in claim 2 wherein said intermediate layer is further characterized by:

a. an upper layer;

b. a lower layer; and c. said upper layer comprises dense graded aggregate filler material of preselected thickness.

4. A beam-like pavement structural section as defined in claim 1 wherein said top layer is asphalt concrete.

5. A beam-like pavement structural section as defined in claim 4 further characterized in that said top layer of asphalt concrete is dense graded.

6. A beam-like pavement structural section as defined in claim 4 further characterized in that said top layer of asphalt concrete is open graded.

7. A beam-like pavement structural section as defined in claim 1 further characterized in that said top layer is surface treatment.

8. A beam-like pavement structural section as defined in claim 4 further characterized in that said top layer of asphalt concrete is dense graded of predetermined thickness.

9. A beam-like pavement structural section as defined in claim 4 further characterized in that said top layer of asphalt concrete is open graded of predetermined thickness.

10. A beam-like pavement structural section as defined in claim 4 further characterized in that said top layer is checked with sand and asphalt.

11. A beam-like pavement structural section as defined in claim 1 further characterized in that said bottom layer comprises dense graded asphalt concrete as preselected bitumen type and content, and of preselected thickness so that said bottom layer possesses the greatest fatigue tensile strength of said structure, the greatest material stiffness in a repetitive tensile stress load environment of said structure, the greatest resistance to the free movement of water of said structure, and the greatest resistance to the diffusion of air, hence, the greatest resistance to the chemical deterioration, i.e., hardening, of the bituminous bound layers of said structure.

12. A beam-like pavement structural section as defined in claim 11 further characterized in that said bottom layer comprises densed graded asphalt concrete of preselected mineral filler type and content so that said bottom layer possesses still greater fatigue tensile strength, and still greater material stiffness of said structure.

13. A beam-like pavement structural section as defined in claim 1 wherein said upper layer is further characterized by:

a. an upper layer;

b. a lower layer; and c. said lower layer comprises open graded asphalt concrete of preselected thickness as to have sufficient stability to support the construction equipment for its densification and for densification of the intermediate layer and for laydown of the surface course and for support of high volume traffic.

14. A method for constructing a beam-like asphalt pavement structural section over a subgrade comprising the steps of arranging a plurality of layers of material in a preselected sequence and of preselected thicknesses including laying a bottom layer of dense graded asphalt concrete on the subgrade, said bottom layer having a greater tensile strength than the other layers, and laying an intermediate layer of unbound aggregate filler material to enhance the beam-like action of the bottom layer, and laying a top layer of asphalt concrete on the intermediate layer".

* * * * *